United States Patent [19]

Kegel et al.

[11] Patent Number: 4,836,108

[45] Date of Patent: Jun. 6, 1989

[54] MATERIAL FOR MULTIPLE COMPONENT PENETRATORS AND PENETRATORS EMPLOYING SAME

[75] Inventors: Andrew J. Kegel, Albany, Oreg.; James R. Spencer, Sayre, Pa.; James S. Smith, Towanda, Pa.; Russell H. Rhodes, Monroeton, Pa.; James A. Mullendore, Towanda, Pa.

[73] Assignee: GTE Products Corporation, Stamford, Conn.

[21] Appl. No.: 202,355

[22] Filed: Jun. 6, 1988

Related U.S. Application Data

[63] Continuation of Ser. No. 845,108, Mar. 27, 1986, and a continuation-in-part of Ser. No. 580,985, Feb. 16, 1984, which is a continuation-in-part of Ser. No. 297,902, Aug. 31, 1981.

[51] Int. Cl.[4] ..... F42B 1/02; F42B 11/08

[52] U.S. Cl. ..... 102/306; 102/307; 102/476; 102/506; 102/517

[58] Field of Search ..... 102/306–310, 102/476, 505, 506, 517–519; 428/430

[56] References Cited

U.S. PATENT DOCUMENTS

| | | | |
|---|---|---|---|
| 2,393,648 | 1/1946 | Martin | 102/519 |
| 3,254,995 | 6/1966 | Goodfellow et al. | 420/430 |
| 3,888,636 | 6/1975 | Szerzenie et al. | 102/501 X |
| 4,458,599 | 7/1984 | Mullendore et al. | 102/517 |
| 4,702,171 | 10/1987 | Tal et al. | 102/476 |
| 4,747,350 | 5/1988 | Szecket et al. | 102/306 |

FOREIGN PATENT DOCUMENTS 51375 5/1982 European Pat. Off. .

*Primary Examiner*—Peter A. Nelson
*Attorney, Agent, or Firm*—Donald R. Castle

[57] ABSTRACT

Multiple component frangible penetrators comprise a body portion of a frangible material and a heavy alloy machinable tail portion. Nose components joined to the opposing end of the body portions can be a variety of materials.

1 Claim, 1 Drawing Sheet

MATERIAL FOR MULTIPLE COMPONENT PENETRATORS AND PENETRATORS EMPLOYING SAME

CROSS REFERENCE TO A RELATED APPLICATION

This application is a continuation of application Ser. No. 845,108, filed 3/27/86.

This application is a continuation-in-part of U.S. patent application Ser. No. 580,985, filed Feb. 16, 1984 which was a continuation-in-part of U.S. patent application Ser. No. 297,902, filed on Aug. 31, 1981, entitled "Material For Multiple Component Penetrators And Penetrators Employing Same". Each prior application and this application has the same title and the same inventors and are assigned to the same assignee as is this application.

The present invention relates to materials for multiple component penetrators and penetrators using same. More particularly it relates to kinetic energy penetrators having a frangible component and a machinable component.

BACKGROUND OF THE INVENTION

Frangible materials are known. For example, in U.S. patent application Ser. No. 296,758, filed Aug. 27, 1981 now U.S. Pat. No. 4,458,599, there is described a frangible tungsten material. As used herein the term "frangible material" means a material which, under high velocity impact against a target, will break into small fragments while penetrating the target. While frangible materials can penetrate light armor and break up into small fragments generally they are difficult to machine using conventional machining techniques.

Some penetrators have a cavity in the rear section for a tracer and in some instances the cavity also holds a self-destruct mechanism. If the rear section is made of the frangible material, the cavity can cause the material to break apart prematurely. Additionally, in some penetrators it is desired to provide a windscreen of a lighter weight material.

It is believed, therefore, that a kinetic energy penetrator having a center component of a frangible material and a rear heavy alloy machinable component and which can optionally have a number of different nose components would provide flexibility in manufacture overcome some of the problems associated with the prior art and constitute an advancement in the art.

DETAILED DESCRIPTION

For a better understanding of the present invention together with other and further objects, advantages and capabilities thereof reference is made to the following disclosure and appended claims in connection with the above description of some of the aspects of the invention.

As previously mentioned frangible materials are known. The annealed tungsten as disclosed in U.S. Pat. Ser. No. 296,758, filed Aug. 27, 1981 now U.S. Pat. No. 4,458,599, and assigned to the same assignee as the present application, which is incorporated by reference herein is the preferred material. That material is an annealed tungsten having from about 5 to about 20 grains per square millimeter and a hardness of from about 31 to 35 on the Rockwell C hardness scale. While in U.S. Pat. No. 4,458,599 it is stated that some tungsten materials in the past containing minor amounts of iron, nickel and copper are not frangible, it has been found that certain other alloys of tungsten are frangible, such as 98W-2Ni, and 90W-10Mo and tungsten doped with about 400 ppm of nickel. Additionally, tungsten-nickel-iron alloys containing from about 97% to about 99% tungsten, balance iron and nickel wherein the weight percent of iron is greater than the weight percent of nickel are frangible materials. All of these materials will penetrate a target such as a 2" thick steel armor plate, when fired at a high velocity such as from an anti-tank gun, then break into small fragments while penetrating or exiting from the plate. Such materials, while exhibiting the desired frangibility, have a tendency to form cracks when cavities are machined into the tail of the penetrator for tracer or self-destruction mechanisms. The cracks can cause premature fragmentation.

"Heavy alloys" are that class of two phase multi-component tungsten alloys containing nickel and at least one other metal and in which one phase is essentially tungsten and the other phase is a solid-solution of nickel, tungsten and the other metal or metals. It has been found that the heavy alloys are suitable for forming the tail component of a penetrator where a cavity is to be machined into the tail component. It is preferred to use heavy alloys having a density of at least about 16.7 grams/cc, therefore these alloys containing at least about 88% tungsten and the balance being nickel and other metals such as copper, molybdenum, iron, titanium and the like. A particularly preferred alloy is 97.3W-1.35Ni-1.35Fe.

Figure 1:
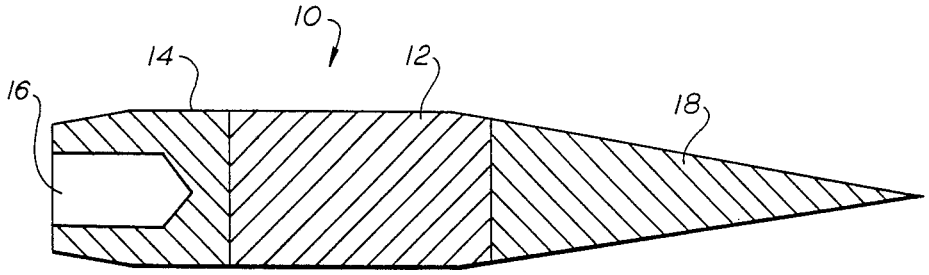
FIGS. 1, 2 and 3 are cross-section views of different embodiments of the present invention.

The projectiles of the present invention have multiple components of different materials. With particular reference to FIG. 1, a cross section of penetrator 10 is shown comprising a body component 12, and a tail component 14 containing a tracer cavity 16. Nose component 18 is of the same material as the body component 12 and can be either fabricated in one section comprising both the body component 12 and nose portion component 18 or if desired the pieces can be fabricated separately and the nose component 18 can be joined to one end of body component 12. The method of joining the components can be brazing, inertial welding and the like. The tail component 14 is similarly joined to the opposite end of body component 12. Frangible materials as previously described are used for the body portion 12 and nose component 18. Each of these materials will penetrate the targets up to about 2" thick steel and will break into small pieces upon exiting the target.

The tail portion is the heavy alloy as previously described having a density of at least 16.7 grams/cc.

Figure 2:
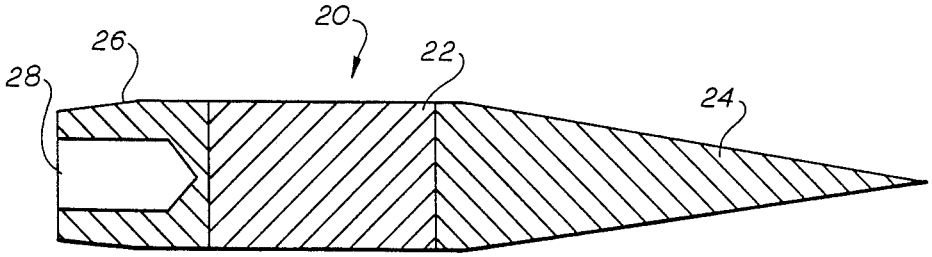

With particular reference to FIG. 2 a cross section of a penetrator 20 having three segments is shown. Body component 22 is a frangible material. The nose component 24 can be the same material as the body portion or a different material. Tail component 26 is essentially identical to the tail portion of FIG. 1, that, is it is a machinable heavy alloy. The penetrator 20 also contains a tracer cavity 28.

Figure 3:
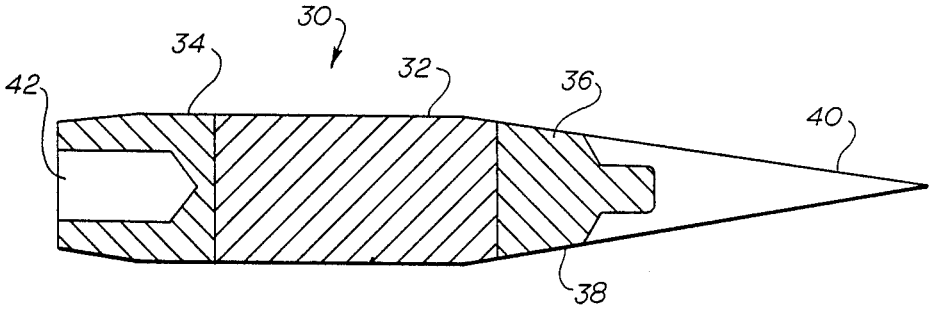

With particular reference to FIG. 3 there is provided a penetrator 30 having four separate segments. Body component 32 is made of the aforementioned annealed tungsten or tungsten containing 400 ppm of nickel. The tail component 34 and one section 36 of the nose component 38 are made of the machinable heavy alloy. A second section 40 extends from the first section 36 to serve as a windscreen and is a lighter weight material such as aluminum or a ceramic material. The nose component 38 thus is comprised of a first section 36 which is machined to enable attachment of the second section 40 which serves as a windscreen. The cavity 42 is shown in the tail component 34.

While there has been shown and described what are at present considered the preferred embodiments of the invention, it will be obvious to those skilled in the art that various changes and modifications may be made therein without departing from the scope of the invention as defined by the appended claims.

What is claimed:

1. A penetrator comprising a body component of a frangible material selected from the group consisting of (a) an annealed tungsten having from about 5 to about 20 grains per square millimeter and a hardness of from about 31 to about 35 on the Rockwell C hardness scale, (b) a tungsten alloy consisting essentially of 98% by weight of tungsten and 2% by weight of nickel, (c) a tungsten alloy consisting essentially of 90% by weight of tungsten and 10% by weight of molybdenum and (d) tungsten doped with about 400 parts per million of nickel, a heavy alloy tail component joined to one end of the body component.

* * * * *